US011685026B2

(12) United States Patent
Chen et al.

(10) Patent No.: US 11,685,026 B2
(45) Date of Patent: Jun. 27, 2023

(54) TOOL JOINT

(71) Applicant: YUAN LI HSING INDUSTRIAL CO., LTD., Taichung (TW)

(72) Inventors: Chia-Yi Chen, Taichung (TW); Hui-Chien Chen, Taichung (TW)

(73) Assignee: YUAN LI HSING INDUSTRIAL CO., LTD., Taichung (TW)

( * ) Notice: Subject to any disclaimer, the term of this patent is extended or adjusted under 35 U.S.C. 154(b) by 288 days.

(21) Appl. No.: 17/162,829

(22) Filed: Jan. 29, 2021

(65) Prior Publication Data

US 2022/0241940 A1 Aug. 4, 2022

(51) Int. Cl.
*B25B 23/00* (2006.01)
*B25B 21/00* (2006.01)

(52) U.S. Cl.
CPC ..... *B25B 23/0035* (2013.01); *B25B 23/0014* (2013.01); *B25B 21/00* (2013.01)

(58) Field of Classification Search
CPC . B25B 23/0035; B25B 23/0014; B25B 21/00; B25B 15/02; B25B 13/06; B25B 23/0028; B25G 1/005; B25G 1/063; B25G 1/085
USPC ..... 81/438, 440, 177.85, 439, 450
See application file for complete search history.

(56) References Cited

U.S. PATENT DOCUMENTS 7,363,839 B2 * 4/2008 Chiang ..... B25B 23/0035 81/177.85
7,565,854 B2 * 7/2009 Chiang ..... B25B 15/001 81/429
7,966,915 B2 * 6/2011 Chen ..... B25B 23/0028 464/151
10,391,616 B1 * 8/2019 Cantion ..... B25B 23/0028
2012/0272795 A1 * 11/2012 Chen ..... B25B 23/12 81/177.75

* cited by examiner

*Primary Examiner* — Don M Anderson
*Assistant Examiner* — Jason Khalil Hawkins
(74) *Attorney, Agent, or Firm* — Muncy, Geissler, Olds & Lowe, P.C.

(57) ABSTRACT

A tool joint is provided, including a main body, a swingable member and a locking structure. The main body has a connecting channel. The swingable member is disposed on the main body. A driving rod is disposed through the swingable member and movable between a first position and a second position. When the driving rod is in the first position, the driving rod is out of the connecting channel, the swingable member is swingable relative to the main body. When the driving rod is in the second position, the driving rod projects within the connecting channel and the swingable member is non-swingable relative to the main body.

10 Claims, 11 Drawing Sheets

TOOL JOINT

BACKGROUND OF THE INVENTION

Field of the Invention

The present invention relates to a tool joint.

Description of the Prior Art

There are many types of objects to be driven, such as screws, nuts, tool bits etc., so it requires the connector for adapting. The conventional adapting connector is simple in structure and provided with a connecting hole at one end, and the other end of the conventional adapting connector is provided in the form of insertion-receiving configuration. For various use requirements, a universal connector is developed.

Through a driving head swingably received within a socket member of the universal connector, the driving head can drive the object to be driven at various angles, so it can be applied to various operation environments.

However, this kind of universal connector still has shortcomings in actual use. For example, for safety, stability in use, combination firmness and universal switchability need to be further improved.

The present invention is, therefore, arisen to obviate or at least mitigate the above-mentioned disadvantages.

SUMMARY OF THE INVENTION

The main object of the present invention is to provide a tool joint which is operable in a swingable state or a non-swingable and locking state.

To achieve the above and other objects, the present invention provides a tool joint, including: a main body, including a connecting channel and an assembling space which is in communication with the connecting channel along a first direction; a swingable member, including a head portion, a connecting rod and an insertion hole, the connecting rod being connected with the head portion, the head portion being polygonal ball shaped, the head portion being received and optionally movable in the assembling space so that the connecting rod is optionally swingable relative to the main body, the insertion hole being disposed through the head portion and the connecting rod, the insertion hole including a first end and a second end opposite to each other, the second end being in communication with the connecting channel, the first end being configured for insertion of a driving rod which is movable between a first position where the driving rod is non-protrusive beyond the second end and a second position where the driving rod is protrusive beyond the second end and projects within the connecting channel, the connecting channel being configured to block the driving rod in a direction perpendicular to the first direction, the insertion hole being non-circular; and a locking structure, including at least one positioning hole, at least one positioning member, a first elastic member and a sleeve, the at least one positioning hole being disposed through the connecting rod and laterally in communication with the insertion hole, the at least one positioning member being movably received within the at least one positioning hole, the sleeve being disposed around the connecting rod and being movable between a locking position and a release position, wherein when the sleeve is located in the locking position, a first rib portion of the sleeve urges the at least one positioning member to be within the insertion hole so as to position the driving rod, when the sleeve is located in the release position, a receiving room of the sleeve receives part of the at least one positioning member so that the at least one positioning member is out of the insertion hole to release the driving rod, and wherein the first elastic member is disposed between the sleeve and the connecting rod to biases the sleeve toward the locking position.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Please refer to FIGS. 1 to 8 for a first preferable embodiment of the present invention. A tool joint 1 of the present invention includes a main body 1, a swingable member 2 and a locking structure 3.

Figure 1:
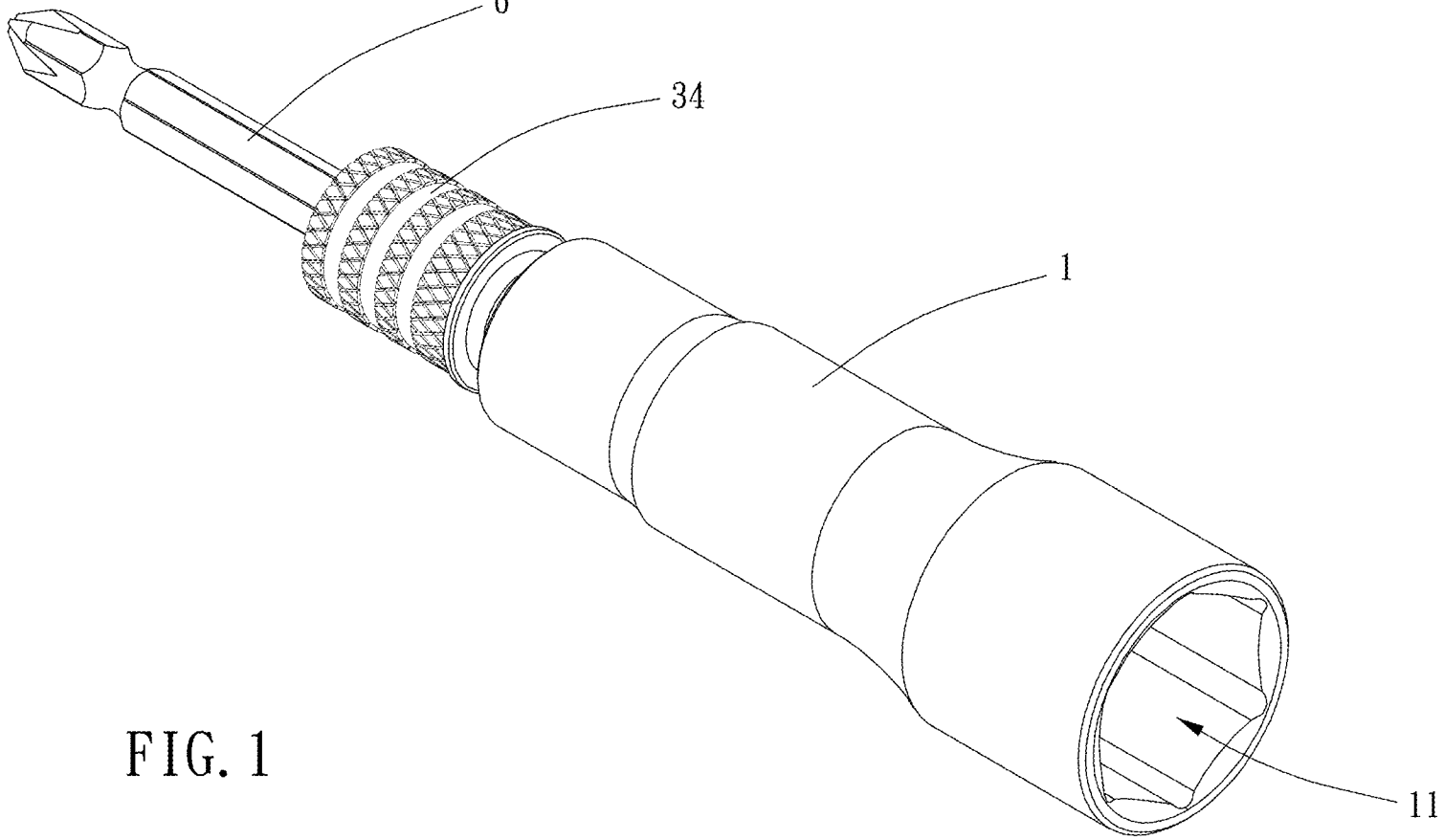
FIG. 1 is a stereogram of a first preferable embodiment of the present invention.
Figure 2:
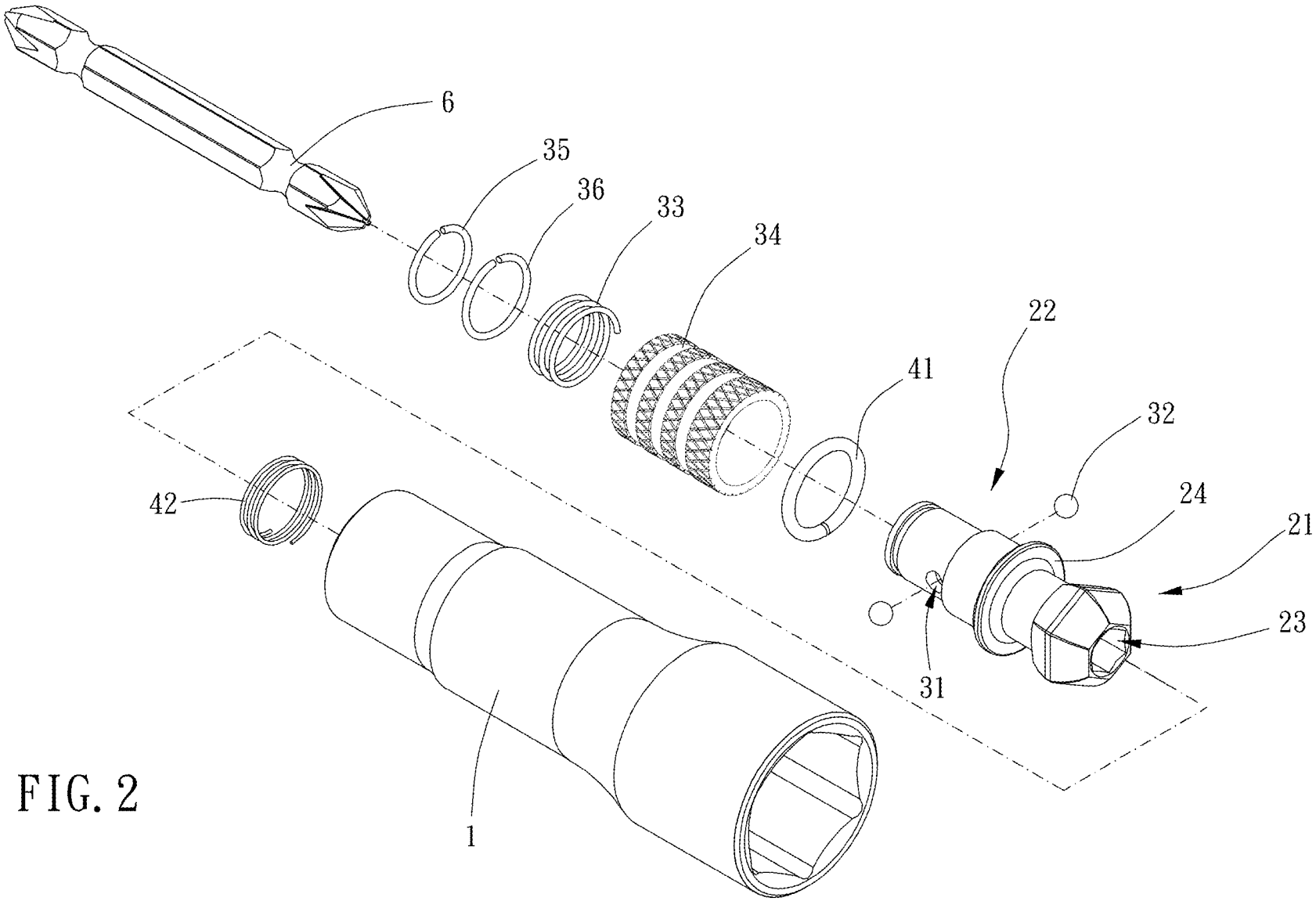
FIG. 2 is a breakdown drawing of FIG. 1.
Figure 3:
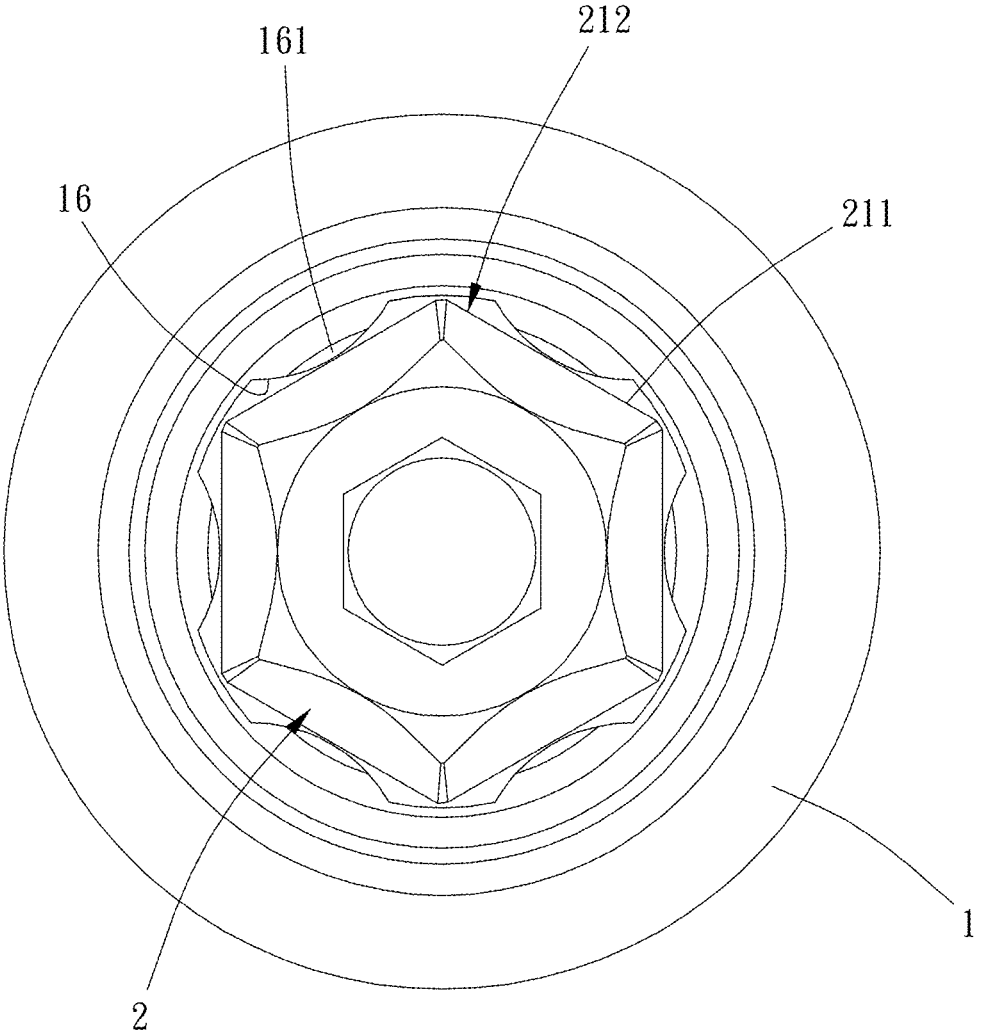
FIG. 3 is a drawing showing a swingable member received within a main body according to the first preferable embodiment of the present invention.
Figure 4:
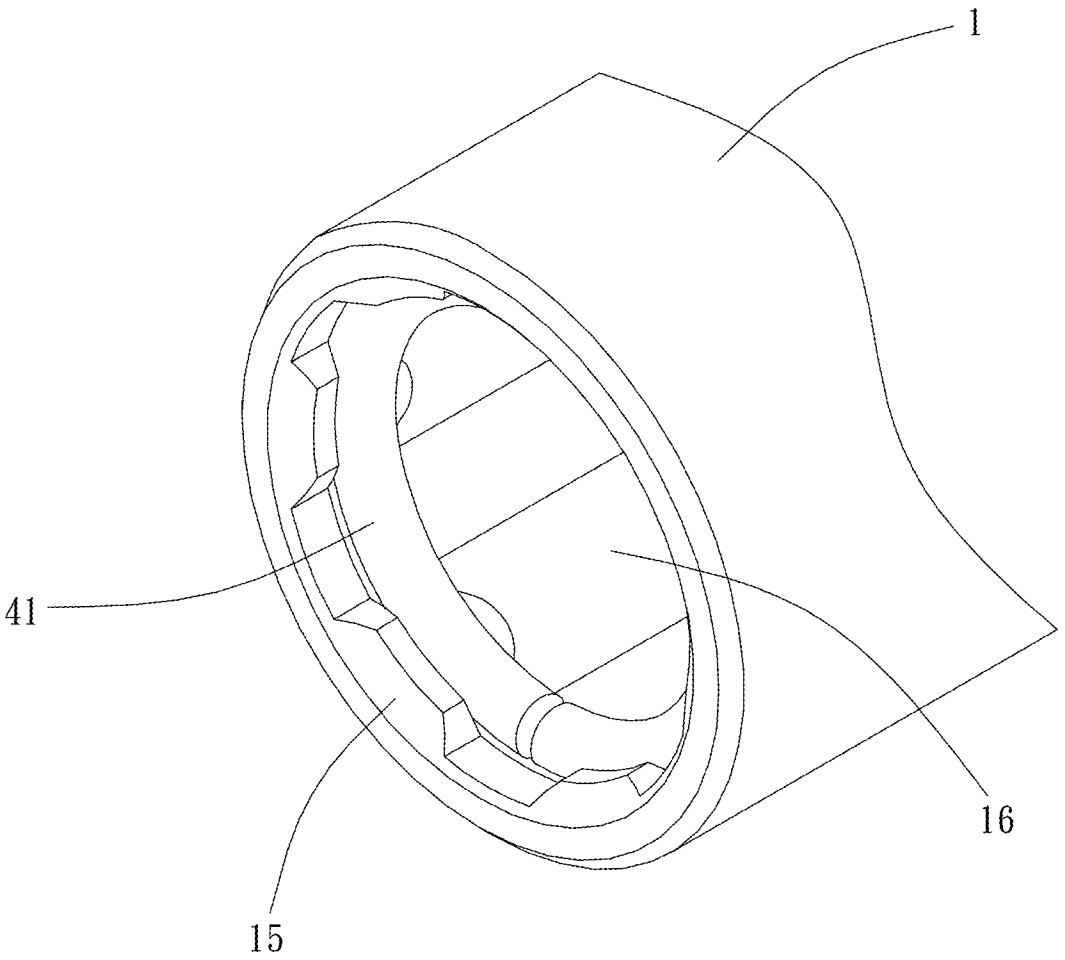
FIG. 4 is a drawing showing a retaining ring engaged within an annular groove according to the first preferable embodiment of the present invention.
Figure 5:
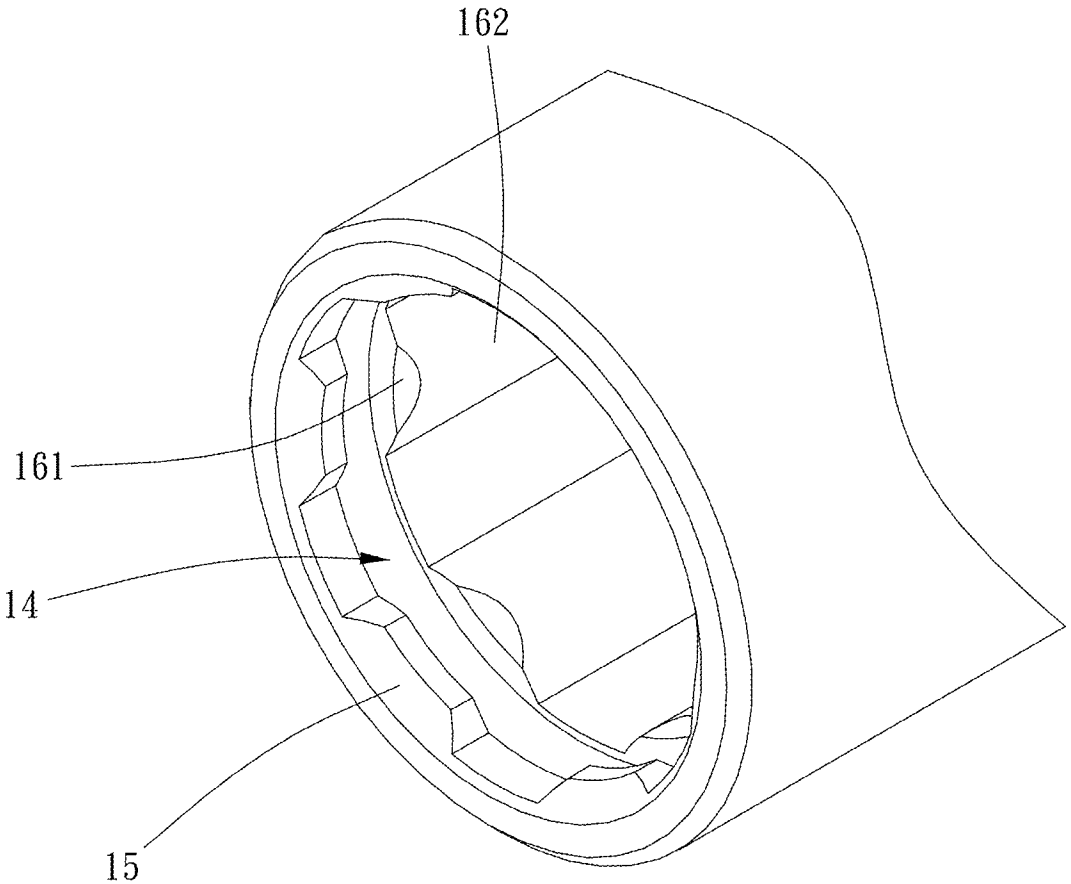
FIG. 5 is a stereogram showing the retaining ring being removed from the annular groove according to the first preferable embodiment of the present invention.
Figure 6:
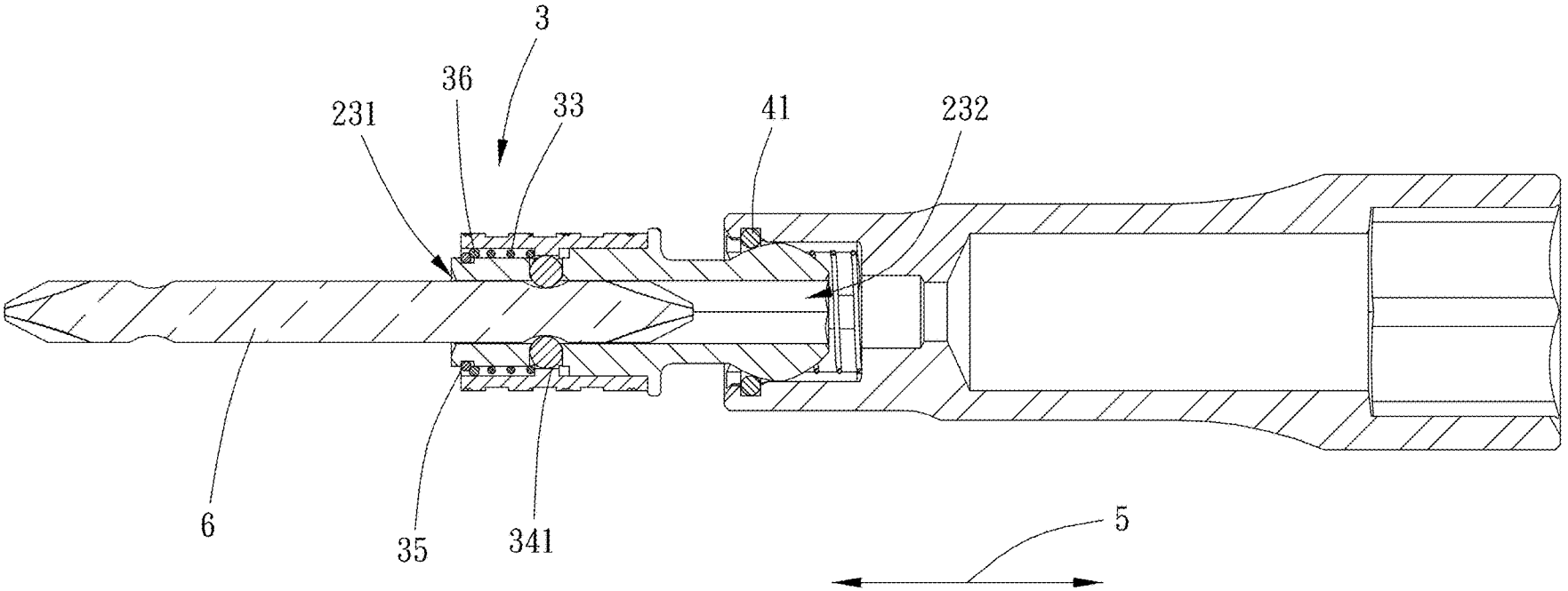
FIG. 6 is a cross-sectional view showing a driving rod located in a first position and a sleeve located in a locking position according to the first preferable embodiment of the present invention.
Figure 7:
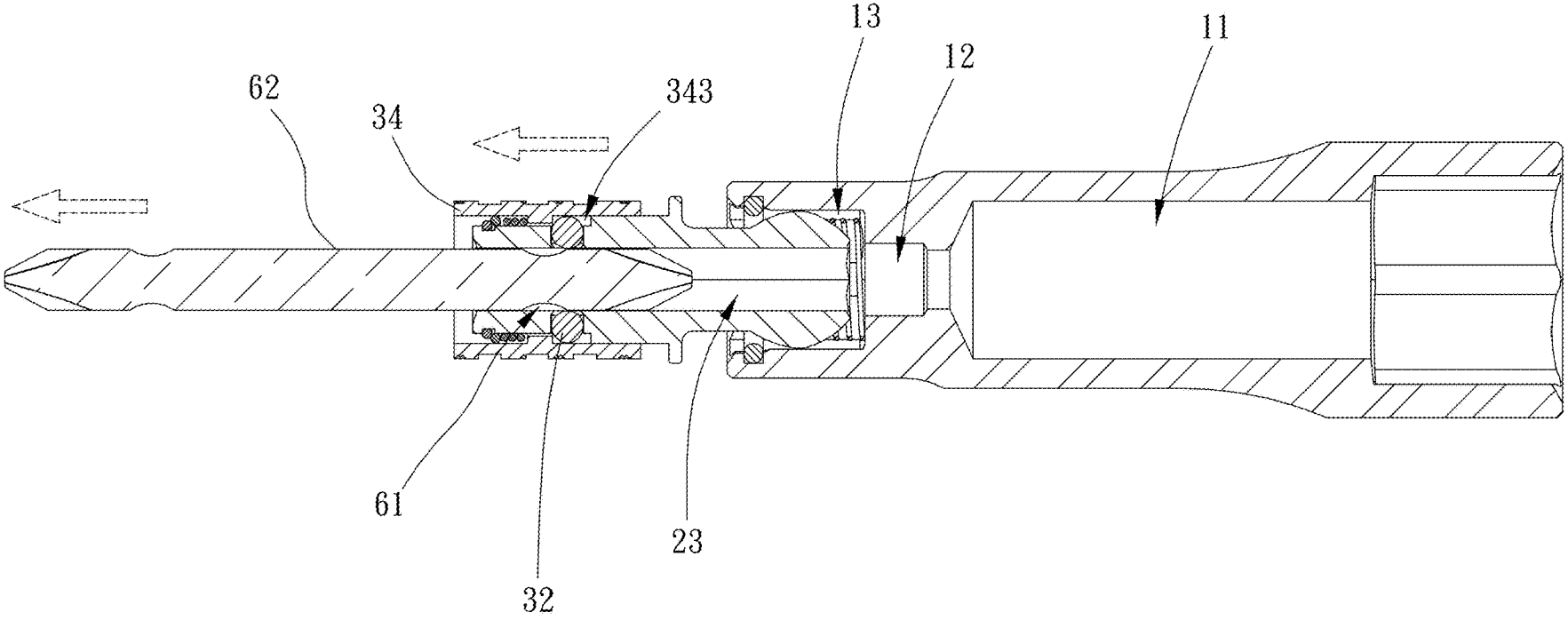
FIG. 7 is a cross-sectional view showing the sleeve located in a release position according to the first preferable embodiment of the present invention.
Figure 8:
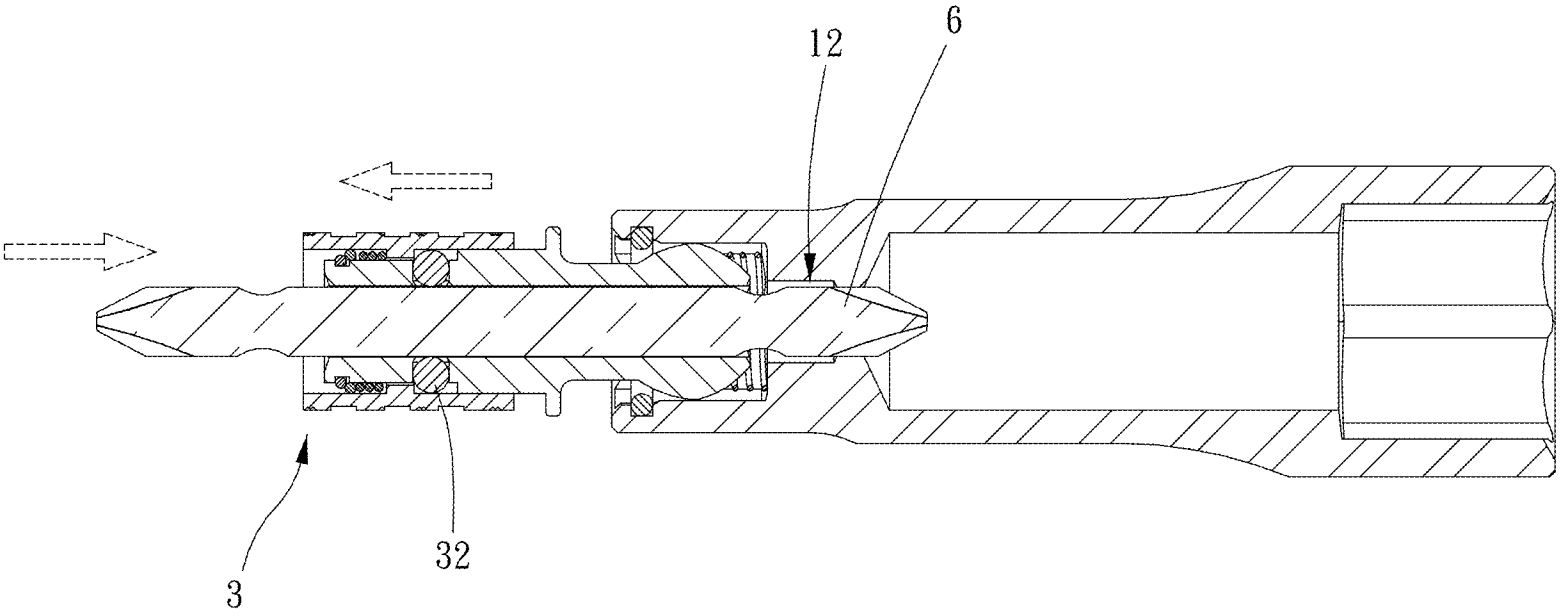
FIG. 8 is a cross-sectional view showing the driving rod located in a second position according to the first preferable embodiment of the present invention.

The main body 1 includes a connecting channel 12 and an assembling space 13 which is in communication with the connecting channel 12 along a first direction 5. The main body further includes a connection room 11, the connecting channel 12 is in communication with and between the assembling space 13 and the connection room 11. In a direction perpendicular to the first direction 5, the largest diametric dimension of the assembling space 13 is greater than the largest diametric dimension of the connecting channel 12, the largest diametric dimension of the connection room 11 is greater than the largest diametric dimension of the assembling space 13. The connection room 11 is configured to be connected with a power tool. In a third embodiment as shown in FIG. 3, the main body 1A further includes a connecting projection 7 configured to be connected with a power tool.

The swingable member 2 includes a head portion 21, a connecting rod 22 and an insertion hole 23. The connecting rod 22 is connected with the head portion 21, the head portion 21 is polygonal ball shaped, and the head portion 21 is received and optionally movable in the assembling space 13 so that the connecting rod 22 is optionally swingable relative to the main body 1. The insertion hole 23 is disposed through the head portion 21 and the connecting rod 22.

The insertion hole 23 includes a first end 231 and a second end 232 opposite to each other. The second end 232 is in communication with the connecting channel 12, and the first end 231 is configured for insertion of a driving rod 6 which is movable between a first position where the driving rod 6 is non-protrusive beyond the second end 232 and a second position where the driving rod 6 is protrusive beyond the second end 232 and projects within the connecting channel 12. The insertion hole 23 is non-circular so that the driving rod 6 and the swingable member 2 are movable with each other. When the driving rod 6 is in the first position, the swingable member 2 is movable relative to the main body 1. When the driving rod 6 is in the second position, the connecting channel 12 is configured to block the driving rod 6 in a direction perpendicular to the first direction 5. In other words, the driving rod 6 connects the swingable member 2 and the main body 1 in series so that the swingable member 2 is positioned and unmovable relative to the main body 1.

Specifically, in the first direction 5, a length of the insertion hole 23, a sum of a length of the assembling space 13 and a length of the connecting channel 12 is smaller than a length of the driving rod 6 so as to ensure that the driving rod 6 has the sufficient length to be located in the second position. In the first direction 5, the length of the insertion hole 23 is greater than a sum of the length of the assembling space 13 and the length of the connecting channel 12 so as to ensure that there is larger contact area between the swingable member 2 and the driving rod 6 for stable movement. In the first direction 5, a ratio of the length of the assembling space 13 to the connecting channel 12 is between 1.3 and 1.6, which provides sufficient assembling space 13 for receiving the head portion 21 and sufficient length of the connecting channel 12 for receiving the driving rod 6.

The locking structure 3 includes at least one positioning hole 31, at least one positioning member 32, a first elastic member 33 and a sleeve 34. The at least one positioning hole 31 is disposed through the connecting rod 22 and laterally in communication with the insertion hole 23, the at least one positioning member 32 is movably received within the at least one positioning hole 31, and the sleeve 34 is disposed around the connecting rod 22 and movable between a locking position and a release position. When the sleeve 34 is located in the locking position, a first rib portion 341 of the sleeve 34 urges the at least one positioning member 32 to be within the insertion hole 23 so as to position the driving rod 6. When the sleeve 34 is located in the release position, a receiving room 343 of the sleeve 34 receives part of the at least one positioning member 32 so that the at least one positioning member 32 is out of the insertion hole 23 to release the driving rod 6. The first elastic member 33 is disposed between the sleeve 34 and the connecting rod 22 to biases the sleeve 34 toward the locking position, which prevents disengagement of the driving rod 6 during operation.

In the first embodiment, the at least one positioning hole includes two positioning holes 31 and the at least one positioning member includes two positioning members 32. The two positioning holes 31 are symmetrically arranged so that the force applied to the driving rod 6 is evenly distributed. The driving rod 6 includes an outer wall 62 and a locking portion 61, and the locking portion 61 is recessed on the outer wall 62. When the sleeve 34 is located in the locking position, the two positioning members 32 are partially engaged within the locking portion 61 to block the driving rod 6. When the sleeve 34 is located in the release position, the two positioning members 32 are abutted between the outer wall 62 and the sleeve 34 in a direction perpendicular to the first direction 5 so that the driving rod 6 is restricted, during movement, by the two positioning members 32. As a result, when the driving rod 6 is located in the second position, the sleeve 34 is kept in the release position to provide safety operation.

Specifically, a retaining ring 41 is received within an annular groove 14 of the main body 1, the annular groove 14 is located in the assembling space 13, and the retaining ring 41, in the first direction, blocks the head portion from detaching from the assembling space 13. Specifically, a plurality of first projections 15 are equiangularly arranged around the assembling space 13, and a plurality of second projections 16 respectively extend in the first direction 5 and each correspond to one of the plurality of first projections 15. The plurality of first projections 15 and the plurality of second projections 16 are separated by the annular groove 14, the plurality of second projections 16 are configured to abut the head portion 21 in a direction perpendicular to the first direction 5. Each said second projection 16 includes an inclined guide face 161 next to the annular groove 14 and configured to guide the head portion 21 into the assembling space 13.

In the first embodiment, the plurality of first projections includes six first projections 15 and the plurality of second projections includes six second projections 16. The head portion 21 is hexagonal. When the connecting rod 22 and the main body 1 are coaxially arranged, the six second projections 16 are respectively abutted against six sides 211 of the head portion 21, and six corners 212 of the head portion 21 are free of contact with an inner surface of the assembling space 13.

Preferably, a second elastic member 42 is disposed between a bottom face of the assembling space 13 and the head portion 21 so that the head portion 21 is urged to abut the retaining ring 41. During rotation of the head portion 21, the retaining ring 41 can well support the head portion 21, and the head portion 21 can rotate stably.

The locking structure 3 further includes a first ring member 35 and a second ring member 36. The second ring member 36 has a diametric dimension larger than a diametric dimension of the first ring member 35, and the first ring member 35 is engaged within the connecting rod 22. The second ring member 36 disposed around the connecting rod 22, and the second ring member 36 is overlapped and blockable with the first ring member 35 in the first direction 5. The cooperation of the first ring member 35 and the second ring member 36 can simplified processing and assembling, and reduce weight and assembly error. The first ring member 35, the second ring member 36 and the first elastic member 33 are located in the sleeve 34, the second ring member 36 is slidably abutted laterally against an inner surface of the sleeve 34, and the first elastic member 33 is abutted between the second ring member 36 and the sleeve 34.

The swingable member 2 further includes a flange 24, the flange 24 protruding radially from the connecting rod 22, and the sleeve 34 is blockable by the flange 24 in a direction in which the sleeve 34 moves so as to limit the movement stroke of the sleeve 34 and to prevent the sleeve 34 from damage. In the first embodiment, the flange 24 is located on a direction in which the sleeve 34 moves from the release position toward the locking position; that is, the sleeve 34 should be moved toward a direction away from the flange 24 to be located in the release position (for example, pulled forwardly); and when the sleeve 34 is located in the locking position, the sleeve 34 is located on the first direction 5 to be abutted against the flange 24 so that the flange 24 can support the sleeve 34.

Figure 9:
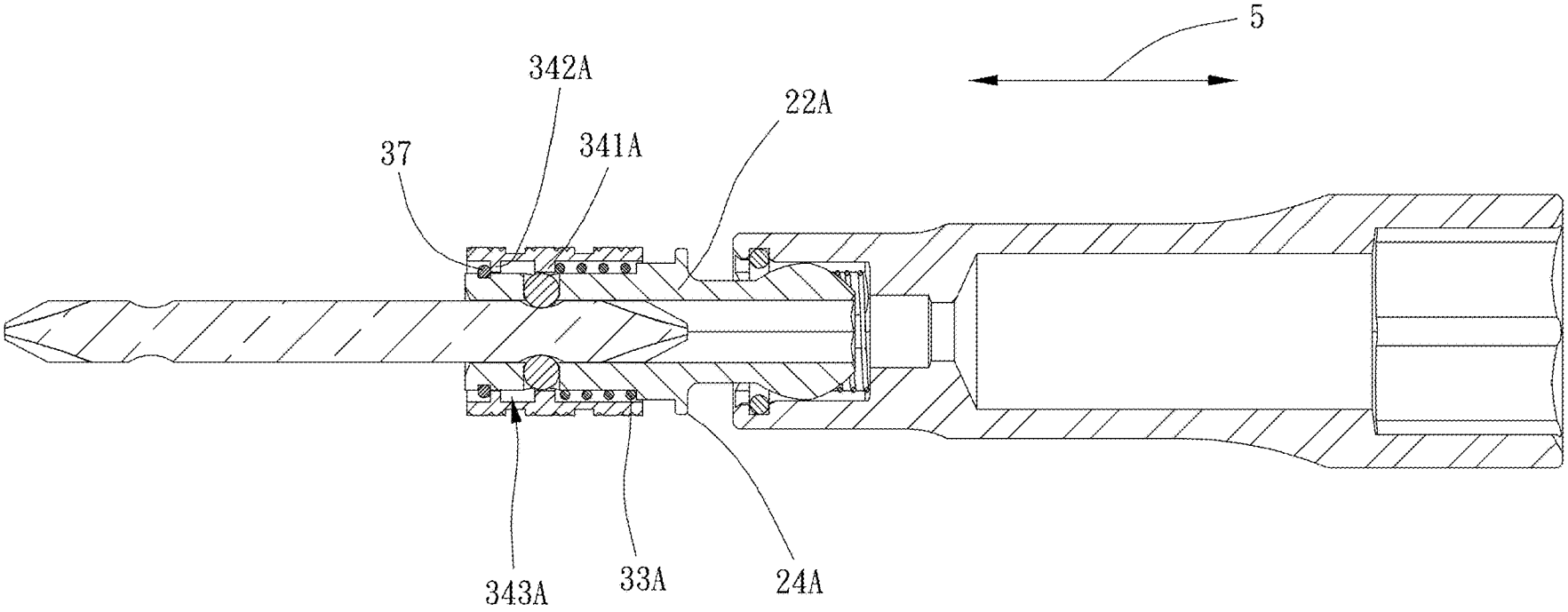
FIG. 9 is a cross-sectional view of a second preferable embodiment of the present invention.
Figure 10:
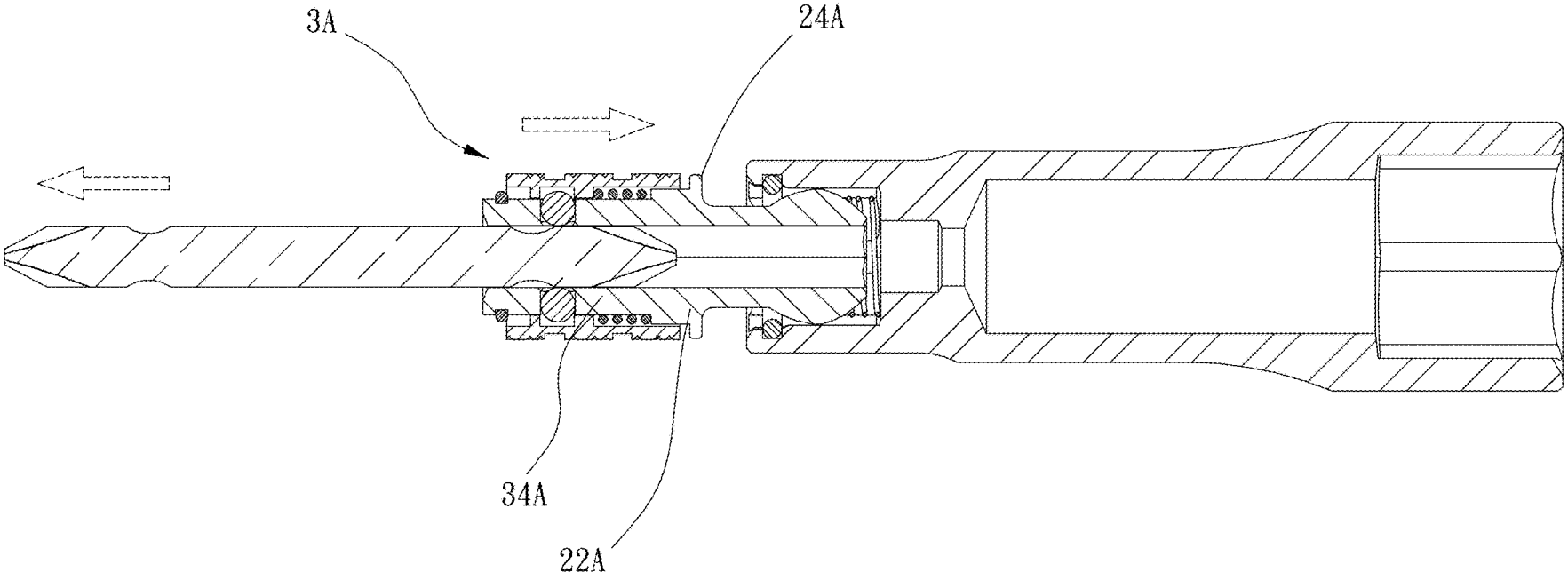
FIG. 10 is a cross-sectional view showing a sleeve located in a release position according to the second preferable embodiment of the present invention.
Figure 11:
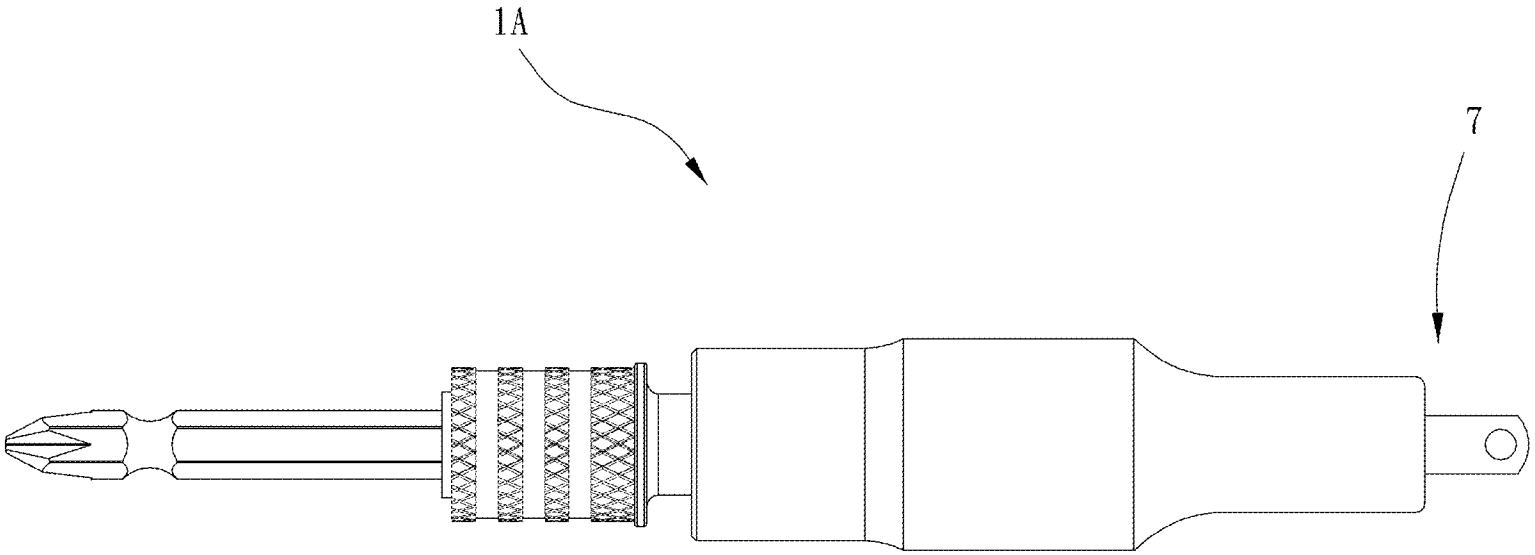
FIG. 11 is a side view of a third preferable embodiment of the present invention.

Please refer to FIGS. 9 and 10 for a second preferable embodiment of the present invention. The locking structure 3A further includes a third ring member 37, the third ring member 37 is engaged within connecting rod 22A, and the sleeve 34A further includes a second rib portion 342. In the first direction the second rib portion 342 and the first rib portion 341 are separate and define the receiving room 343A. The first elastic member 33A is disposed between the first rib portion 341 and the connecting rod 22A, and the first elastic member 33A biases the second rib portion 342 toward the third ring member 37. The third ring member 37 and the second rib portion 342 are overlapped and blockable with each other in the first direction 5, and the third ring member 37 prevents detachment of the sleeve 34A from the connecting rod 22A. The flange 24A is located on a direction in which the sleeve 34A moves from the locking position toward the release position; that is, the sleeve 34A should be moved toward a direction toward the flange 24A to be located in the release position (for example, pulled backwardly).

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A tool joint, including:

a main body, including a connecting channel and an assembling space which is in communication with the connecting channel along a first direction;

a swingable member, including a head portion, a connecting rod and an insertion hole, the connecting rod being connected with the head portion, the head portion being polygonal ball shaped, the head portion being received and movable in the assembling space so that the connecting rod is swingable relative to the main body, the insertion hole being disposed through the head portion and the connecting rod, the insertion hole including a first end and a second end opposite to each other, the second end being in communication with the connecting channel, wherein the tool joint further comprises a driving rod, and the first end being configured for insertion of the driving rod which is movable between a first position where the driving rod is non-protrusive beyond the second end and a second position where the driving rod is protrusive beyond the second end and projects within the connecting channel, the connecting channel being configured to block the driving rod in a direction perpendicular to the first direction, the insertion hole being non-circular; and a locking structure, including at least one positioning hole, at least one positioning member, a first elastic member and a sleeve, the at least one positioning hole being disposed through the connecting rod and laterally in communication with the insertion hole, the at least one positioning member being movably received within the at least one positioning hole, the sleeve being disposed around the connecting rod and being movable between a locking position and a release position, wherein when the sleeve is located in the locking position, a first rib portion of the sleeve urges the at least one positioning member to be within the insertion hole so as to position the driving rod, when the sleeve is located in the release position, a receiving room of the sleeve receives part of the at least one positioning member so that the at least one positioning member is out of the insertion hole to release the driving rod, and wherein the first elastic member is disposed between the sleeve and the connecting rod to biases the sleeve toward the locking position.

2. The tool joint of claim 1, wherein a retaining ring is received within an annular groove of the main body, the annular groove is located in the assembling space, and the retaining ring, in the first direction, blocks the head portion from detaching from the assembling space.

3. The tool joint of claim 2, wherein a second elastic member is disposed between a bottom face of the assembling space and the head portion so that the head portion is urged to abut the retaining ring.

4. The tool joint of claim 2, wherein a plurality of first projections are equiangularly arranged around the assembling space, a plurality of second projections respectively extend in the first direction and each correspond to one of the plurality of first projections in the first direction, the plurality of first projections and the plurality of second projections are separated by the annular groove, the plurality of second projections are configured to abut the head portion in the direction perpendicular to the first direction;

and each said second projection includes an inclined guide face next to the annular groove and configured to guide the head portion into the assembling space.

5. The tool joint of claim 1, wherein the locking structure further includes a first ring member and a second ring member, the second ring member has a diametric dimension larger than a diametric dimension of the first ring member, the first ring member is engaged within the connecting rod, the second ring member is disposed around the connecting rod, the second ring member is overlapped and blockable with the first ring member in the first direction, the first ring member, the second ring member and the first elastic member are located in the sleeve, the second ring member is slidably abutted laterally against an inner surface of the sleeve, and the first elastic member is abutted between the second ring member and the sleeve.

6. The tool joint of claim 1, wherein the locking structure further includes a third ring member, the third ring member is engaged within the connecting rod, the sleeve further includes a second rib portion, in the first direction the second rib portion and the first rib portion are separate and define the receiving room; the first elastic member is disposed between the first rib portion and the connecting rod and biases the second rib portion toward the third ring member, the third ring member and the second rib portion are overlapped and blockable with each other in the first direction, and the third ring member prevents detachment of the sleeve from the connecting rod.

7. The tool joint of claim 1, wherein the swingable member further includes a flange protruding radially from the connecting rod, and the sleeve is blockable by the flange in a direction in which the sleeve moves.

8. The tool joint of claim 7, wherein the flange is located on a direction in which the sleeve moves from the release position toward the locking position.

9. The tool joint of claim 7, wherein the flange is located on a direction in which the sleeve moves from the locking position toward the release position.

10. The tool joint of claim 4, wherein a second elastic member is disposed between a bottom face of the assembling space and the head portion so that the head portion is urged to abut the retaining ring; the locking structure further includes a first ring member and a second ring member, the second ring member has a diametric dimension larger than a diametric dimension of the first ring member, the first ring member is engaged within the connecting rod, the second ring member is disposed around the connecting rod, the second ring member is overlapped and blockable with the first ring member in the first direction; the first ring member, the second ring member and the first elastic member are located in the sleeve, the second ring member is slidably abutted laterally against an inner surface of the sleeve, and the first elastic member is abutted between the second ring member and the sleeve; the swingable member further includes a flange protruding radially from the connecting rod, and the sleeve is blockable by the flange in a direction in which the sleeve moves; the flange is located on a direction in which the sleeve moves from the release position toward the locking position; when the sleeve is located in the locking position, the sleeve is abutted against the flange in the first direction; the at least one positioning hole includes two positioning holes and the at least one positioning member includes two positioning members, the two positioning holes are symmetrically arranged;

the plurality of first projections includes six first projections and the plurality of second projections includes six second projections, the head portion is hexagonal, when the connecting rod and the main body are coaxially arranged, the six second projections are respectively abutted against six sides of the head portion, six corners of the head portion are free of contact with an inner surface of the assembling space; the main body further includes a connection room, the connecting channel is in communication with and between the assembling space and the connection room, in the direction perpendicular to the first direction, the largest diametric dimension of the assembling space is greater than the largest diametric dimension of the connecting channel, the largest diametric dimension of the connection room is greater than the largest diametric dimension of the assembling space; in the first direction, a ratio of a length of the assembling space to a length of the connecting channel is between 1.3 and 1.6; in the first direction, a length of the insertion hole is greater than a sum of a length of the assembling space and a length of the connecting channel; in the first direction, a sum of the length of the insertion hole, the length of the assembling space and the length of the connecting channel is smaller than a length of the driving rod; when the driving rod is located in the second position, the sleeve is kept in the release position; the driving rod includes an outer wall and a locking portion, the locking portion is recessed on the outer wall, when the sleeve is located in the locking position, the two positioning members are partially engaged within the locking portion, when the sleeve is located in the release position, the two positioning members are abutted between the outer wall and the sleeve in the direction perpendicular to the first direction.

* * * * *